US011375792B2

(12) United States Patent
Min et al.

(10) Patent No.: US 11,375,792 B2
(45) Date of Patent: Jul. 5, 2022

(54) HAIR DRYER

(71) Applicant: LG ELECTRONICS INC., Seoul (KR)

(72) Inventors: Kyungseok Min, Seoul (KR); Hyunjoo Oh, Seoul (KR); Kwangwoon Ahn, Seoul (KR); Jounyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/078,311

(22) Filed: Oct. 23, 2020

(65) Prior Publication Data

US 2021/0353032 A1 Nov. 18, 2021

(30) Foreign Application Priority Data

May 12, 2020 (KR) ..... 10-2020-0056533

(51) Int. Cl.
*A45D 20/26* (2006.01)
*A45D 20/24* (2006.01)
*A45D 20/12* (2006.01)

(52) U.S. Cl.
CPC ..... *A45D 20/26* (2013.01); *A45D 20/12* (2013.01); *A45D 20/24* (2013.01)

(58) Field of Classification Search
CPC ..... A45D 20/26; A45D 20/12; A45D 20/24
USPC ..... 34/95–100
See application file for complete search history.

(56) References Cited

U.S. PATENT DOCUMENTS 3,840,030 A * 10/1974 Baker ..... A45D 20/50 132/118
4,197,448 A * 4/1980 Harigai ..... A45D 20/10 132/212
4,721,121 A * 1/1988 Adams ..... A45D 20/50 132/212
4,936,027 A * 6/1990 Tsuji ..... A45D 1/04 132/228
5,074,006 A * 12/1991 Eremita ..... A01K 13/002 15/344
6,178,591 B1 1/2001 Dussourd
6,490,756 B2 12/2002 Marshall
(Continued)

FOREIGN PATENT DOCUMENTS

CN 108206600 6/2018
CN 109674176 4/2019
(Continued)

OTHER PUBLICATIONS

Taiwanese Office Action dated Jul. 21, 2021 issued in TW Application No. 109135772.
(Continued)

*Primary Examiner* — Stephen M Gravini
(74) *Attorney, Agent, or Firm* — Ked & Associates

(57) ABSTRACT

A hair dryer is provided that may include a main body, a handle, a flow path, and a fan. The handle may include a handle case having an inner space for forming the flow path and configured to form an exterior of the handle, and a handle frame that extends from the main body in a downward direction so as to be disposed in the inner space of the handle case. The fan may be coupled to the handle frame and spaced apart from an inner circumferential surface of the handle case.

19 Claims, 11 Drawing Sheets

(56) References Cited

U.S. PATENT DOCUMENTS

| | | | | |
|---|---|---|---|---|
| 8,434,238 | B2 * | 5/2013 | Gross | A45D 20/12 34/96 |
| 8,782,920 | B2 * | 7/2014 | Marthinsen | A45D 20/12 34/97 |
| 8,893,400 | B2 * | 11/2014 | Carme | A45D 20/12 34/97 |
| 9,138,118 | B2 * | 9/2015 | Kim | A47L 9/1608 |
| 9,173,468 | B2 | 11/2015 | Moloney | |
| 9,414,662 | B2 * | 8/2016 | Moloney | A45D 20/00 |
| 9,420,864 | B2 * | 8/2016 | Gammack | A45D 20/08 |
| 9,420,865 | B2 * | 8/2016 | Gammack | A45D 20/10 |
| 9,512,959 | B2 * | 12/2016 | Atkinson | A45D 20/00 |
| 9,687,058 | B2 * | 6/2017 | Atkinson | A45D 20/122 |
| 9,808,065 | B2 * | 11/2017 | Moloney | A45D 20/08 |
| 9,808,066 | B2 * | 11/2017 | Moloney | A45D 20/122 |
| 9,986,810 | B2 * | 6/2018 | Bobillier | A45D 20/08 |
| 10,021,951 | B2 * | 7/2018 | Bobillier | A45D 20/12 |
| 10,064,470 | B2 * | 9/2018 | Warne | A45D 20/50 |
| 10,080,414 | B2 * | 9/2018 | Douglas | F16M 13/02 |
| 10,085,538 | B2 * | 10/2018 | Saunders | A45D 20/12 |
| 10,165,843 | B2 * | 1/2019 | Hedges | A45D 20/12 |
| 10,441,050 | B2 | 10/2019 | Blanc et al. | |
| 10,608,297 | B2 * | 3/2020 | Goldman | A45D 44/005 |
| 10,736,477 | B2 * | 8/2020 | Kim | A47L 7/0009 |
| 10,859,290 | B2 | 12/2020 | Herweck | |
| 10,869,529 | B2 * | 12/2020 | Chia | A45D 20/12 |
| 2011/0010958 | A1 | 1/2011 | Clark | |
| 2013/0269201 | A1 | 10/2013 | Courtney et al. | |
| 2015/0007443 | A1 | 1/2015 | Gammack et al. | |
| 2015/0082652 | A1 | 3/2015 | Atkinson | |
| 2016/0166033 | A1 | 6/2016 | Kerr et al. | |
| 2016/0235178 | A1 | 8/2016 | Atkinson | |
| 2016/0298635 | A1 | 10/2016 | Su | |
| 2018/0042356 | A1 | 2/2018 | Pavis | |
| 2018/0049532 | A1 | 2/2018 | Hsu | |
| 2019/0116955 | A1 | 4/2019 | Atkinson et al. | |
| 2020/0085251 | A1 * | 3/2020 | Youn | G05D 27/02 |
| 2021/0007293 | A1 | 1/2021 | Stimpson | |
| 2021/0321738 | A1 * | 10/2021 | Ni | A45D 20/12 |
| 2021/0345750 | A1 | 11/2021 | Depoyian | |
| 2021/0353026 | A1 * | 11/2021 | Min | A45D 20/00 |
| 2021/0353028 | A1 * | 11/2021 | Park | A45D 20/12 |
| 2021/0353032 | A1 * | 11/2021 | Min | A45D 20/24 |
| 2022/0007809 | A1 | 1/2022 | Wang | |

FOREIGN PATENT DOCUMENTS

| | | | | |
|---|---|---|---|---|
| CN | 110537768 | | 12/2019 | |
| EP | 3626109 | B1 * | 5/2021 | G01N 27/605 |
| GB | 2543751 | | 4/2019 | |
| JP | 2006-288516 | | 10/2006 | |
| JP | 2014-217770 | | 11/2014 | |
| JP | 2016-135096 | | 7/2016 | |
| JP | 2016-185402 | | 10/2016 | |
| JP | 6512713 | | 5/2019 | |
| KR | 20-1999-0010222 | | 3/1999 | |
| KR | 10-2012-0085007 | | 7/2012 | |
| KR | 10-2015-0072610 | | 6/2015 | |
| KR | 10-2016-0020555 | | 2/2016 | |
| KR | 10-2016-0020556 | | 2/2016 | |
| KR | 10-2016-0052719 | | 5/2016 | |
| KR | 10-2016-0096888 | | 8/2016 | |
| KR | 10-2017-0095961 | | 8/2017 | |
| KR | 10-2018-0069051 | | 6/2018 | |
| KR | 10-2020-0116277 | | 10/2020 | |
| WO | WO 2017/068322 | | 4/2017 | |
| WO | WO 2021/230442 | | 11/2021 | |

OTHER PUBLICATIONS

Taiwanese Office Action dated Jul. 21, 2021 issued in TW Application No. 109135773.

International Search Report dated Aug. 17, 2021 issued in PCT Application No. PCT/KR2020/012328.

International Search Report dated Aug. 17, 2021 issued in PCT Application No. PCT/KR2020/015109.

U.S. Appl. No. 17/124,673, filed Dec. 17, 2020.

U.S. Appl. No. 17/084,668, filed Oct. 30, 2020.

U.S. Appl. No. 17/078,311, filed Oct. 23, 2020.

International Search Report dated Feb. 8, 2021 issued in Application No. PCT/KR2020/012276.

Korean Notice of Allowance issued in Application No. 10-2020-0056533 dated Jan. 18, 2022.

Korean Notice of Allowance issued in Application No. 10-2020-0056534 dated Nov. 18, 2021.

Korean Notice of Allowance issued in Application No. 10-2020-0056535 dated Nov. 19, 2021.

U.S. Office Action dated May 19, 2022 issued in U.S. Appl. No. 17/124,673.

* cited by examiner

HAIR DRYER

CROSS-REFERENCE TO RELATED APPLICATION(S)

This application claims priority under 35 U.S.C. § 119 to Korean Application No. 10-2020-0056533, filed in Korea on May 12, 2020 which is hereby incorporated in its entirety by reference as if fully set forth herein.

BACKGROUND

1. Field

A hair dryer is disclosed herein.

2. Background

A hair dryer for discharging gas or fluid, such as air, through a gas discharge outlet may be used when a user removes water from his/her hair to a desired level in a state in which the hair is wet or changes a hair style from a current hair style to a desired hair style. The hair dryer may be provided with a fan unit for blowing gas therein, and may be designed to be conveniently used by a user.

U.S. Patent Publication No. 2019/00116955, which is hereby incorporated by reference, discloses a hair dryer, a center of gravity of which is arranged to be adjacent to a handle portion, while a fan unit and a gas inlet are arranged in the handle portion grasped by a user. In this case, a wrist load of a user who controls a gas discharge direction of a gas discharge outlet to a desired direction by grasping the handle portion may be reduced, whereby user convenience may be improved.

However, the hair dryer disclosed in U.S. Patent Publication No. 2019/00116955 is provided with the fan unit inside of the handle portion directly grasped by a user, and the fan unit may generate vibration, which is transferred to the user or causes noise.

In addition, as the fan unit is located within the handle portion, a flow loss may be generated from a gas flow path connected from the handle portion to a main body, reducing gas discharge efficiency. Therefore, effectively reducing vibration or noise generated by a hair dryer to relieve user discomfort, minimize flow loss, and develop an efficient structure with a fan unit inside of a handle portion, becomes an important task in the present technical field.

BRIEF DESCRIPTION OF THE DRAWINGS

The embodiments will be described in detail with reference to the following drawings in which like reference numerals refer to like elements wherein.

DETAILED DESCRIPTION

Reference will now be made to embodiments, examples of which are illustrated in the accompanying drawings, to facilitate those having ordinary skill in the art to implement the embodiments. Embodiments may be implemented in various kinds of different types and non-limited by the embodiments described herein. Wherever possible, the same or like reference numbers have been used throughout the drawings to refer to the same or like components and repetitive description of the same components has been omitted.

In the present specification, if one component is mentioned as 'connected to' or 'accessing' another component, the former component may be connected to accesses the latter component in direct. Yet, it is understood that a different component may be present in-between. On the other hand, if one component is mentioned as 'directly connected to' or 'directly accessing' another component, it is understood that a different component may is not present in-between.

Terms used in the present specification are used to describe a specific embodiment only but have no intention to limit embodiments.

In the present specification, singular expression may include plural expressions unless having a clear meaning in the context.

In the present application, such a terminology as 'include', 'have' and the like intends to designate that a feature, a number, a step, an operation, a component, a part or a combination thereof disclosed in the specification exists and should be understood as not excluding possibility of existence or addition of at least one or more features, numbers, steps, operations, components, parts or combinations thereof.

In addition, in the present specification, the term 'and/or' includes a combination of a plurality of disclosed entries or a prescribed one of a plurality of the disclosed entries. In the present specification, 'A or B' may include 'A', 'B', or 'both A and B'.

Figure 1:
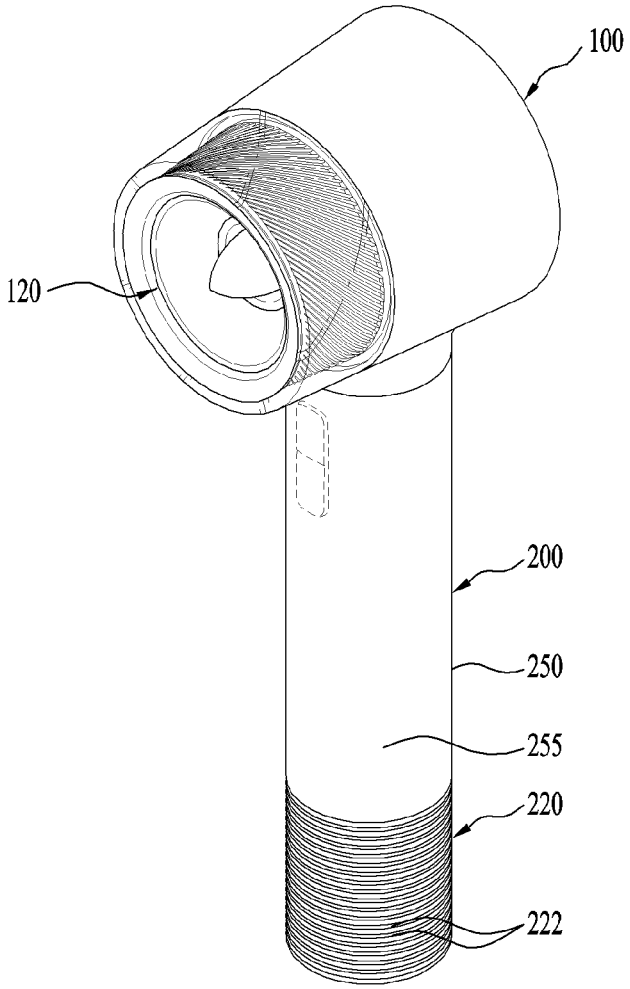
FIG. 1 is a schematic diagram of a hair dryer according to an embodiment.
Figure 2:
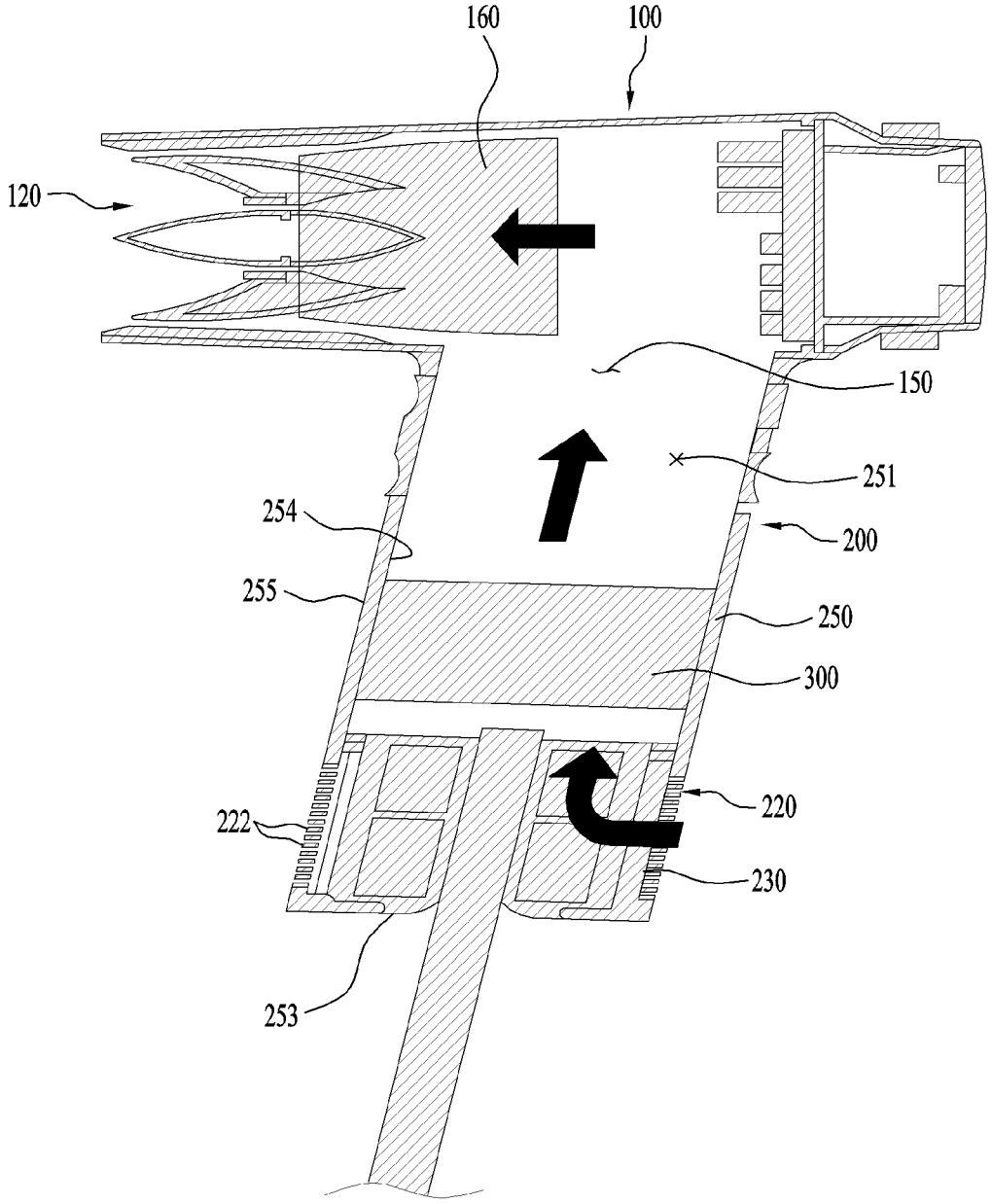
FIG. 2 is a cross-sectional view illustrating an inside of a hair dryer according to an embodiment.

FIG. 1 is a schematic diagram of a hair dryer according to an embodiment. FIG. 2 is a cross-sectional diagram showing the inside of the hair dryer shown in FIG. 1.

As shown in FIG. 1, a hair dryer according to an embodiment may include a main body 100 and a handle portion (handle) 200. The main body 100 may include a gas discharge portion (discharge outlet) 120 through which a gas (or fluid, such as air) flowing in from an outside may be discharged.

The main body 100, as shown in FIG. 2, may include a gas flow path (flow path) 150 formed therein so that the gas may flow therein. The gas flow path 150 may be configured to extend from the handle portion 200 into the main body 100. The gas flow path 150 may be formed by the inside of the main body 100 and the inside of the handle portion 200 and defined as an area extending from a gas intake portion (inlet) 220 to the gas discharge portion 120.

The main body 100 may include the gas discharge portion 120 through which gas flowing along the gas flow path 150 may be discharged externally. The main body 100 may have a shape that extends parallel with a gas discharge direction of the gas discharge portion 120, and may be configured to have various cross-sectional shapes, such as a circle, or a polygon, for example.

Gas flowing in the main body 100 may be suctioned in through the gas intake portion 220 provided in the main body 100 or the handle portion 200. As shown in FIG. 1 and FIG. 2, when the gas intake portion 220 is provided to the handle portion 200, the gas flow path 150 may be configured in a manner of extending from the handle portion 200 to the main body 10, and more particularly, from the gas intake portion 220 to the gas discharge portion 120.

Gas may be suctioned in from outside through the gas intake portion 220 provided in the main body 100 or the handle portion 200. The suctioned-in gas may flow along the gas flow path 150 and may be discharged externally through the gas discharge portion 120 provided to the main body 100.

The handle portion 200 may extend from the main body 100. Referring to FIG. 1 and FIG. 2, the handle portion 200 may approximately extend from the main body 100 in a downward direction. The handle portion 200 may have a shape that extends from the main body 100. The handle portion 200 may be integrally formed with the main body 100. Alternatively, the handle portion 200 may be separately manufactured and then coupled to the main body 100.

If the handle portion 200 is separately manufactured and then coupled to the main body 100, it may be configured to have a fixed or variable lengthwise direction with respect to the main body 100. For example, the handle portion 200 may have a hinge coupling portion and may be configured to be variable in a lengthwise direction of the handle portion 200, that is, foldable with respect to the main body 100 by being coupled to the main body 100.

The handle portion 200 may be a region configured to be held by a hand of a user, thereby having a shape to improve ease of grip. An extending direction of the handle portion 200 may be various. For clarity of the following description, a direction in which the handle portion 200 extends from the main body 100 will be described as a downward direction.

That is, in the present disclosure, upward and downward directions may be defined with reference to the handle portion 200. For example, the handle portion 200 may have a shape that extends from the main body 100 in a downward direction, and the main body 100 may be located in an upward direction.

Therefore, it is not necessary for an upward/downward direction to be understood as a direction vertical to the ground. For clarity of the description, the upward/downward direction may be defined with reference to the handle portion 200.

Referring to FIG. 2, the hair dryer according to an embodiment may include a fan unit (fan) 300 capable of forcing a gas to flow and adjusting a speed of a discharged gas discharged through the gas discharge portion 120. The fan unit 300 may be disposed on or in the gas flow path 150 to force the gas to flow and may be provided within the main body 100 or the handle portion 200.

For example, if the gas intake portion 220 is disposed in the handle portion 200, the gas flow path 150 may extend from the gas intake portion 220 to the gas discharge portion 120 of the main body 100, and the fan unit 300 may be disposed on or in the gas flow path 150 located in the handle portion 200.

A temperature control unit (controller) 160 configured to control a temperature of a discharged gas may be provided within the main body 100. The temperature control unit 120 may be configured in various forms and provided to or at various locations. The temperature control unit 160 provided within the main body 100 is schematically shown in FIG. 2.

In addition, various types of the temperature control unit 160 may be employed. For example, the temperature control unit 160 may heat a gas by generating heat in a manner of applying a current to a resistor of a coil type. The resistor of the temperature control unit 160 may not be a coil type. For example, a gas may be heated using a thermoelement, for example. Thus, various types of controlling a temperature of a gas may be employed.

An operating system of a hair dryer according to an embodiment is schematically described together with a gas flow as follows.

First, a user may manipulate a power button disposed on the main body 100 or the handle portion 200. Once the power button is turned on, the fan unit 300 is activated so that a gas or fluid, such as air, may flow into the hair dryer through the gas intake portion 220.

The gas flowing in through the gas intake portion 220 is forced to flow along the gas flow path 150 by the fan unit 300 toward the gas discharge portion 120. Hence, the discharged gas may be discharged from the gas discharge portion 120, thereby being provided to the user. The gas in the gas flow path 150 may have a flow speed controllable by the fan unit 300 and a temperature controlled by the temperature control unit 160.

The hair dryer according to an embodiment may include a controller. The controller may be configured to control components in a manner of being connected to the fan unit 300, the temperature control unit 160, a power button, and a manipulating portion, for example. An operating state control by the fan unit 300 and the temperature control unit 160 may be performed in a manner that the user manipulates the manipulating portion, or may be automatically performed according to an operation mode preset or predetermined for the controller.

Figure 3:
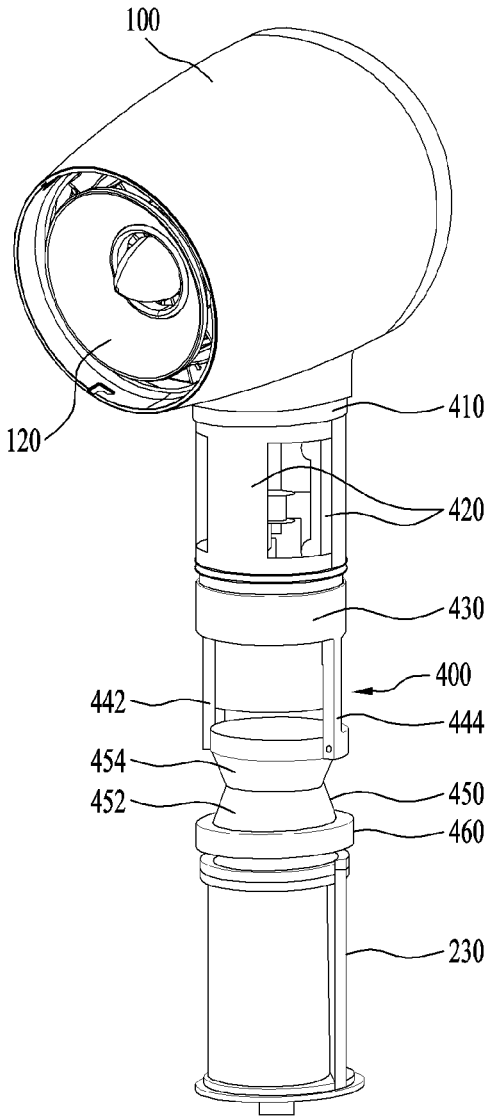
FIG. 3 is a schematic diagram showing a handle case separated from a hair dryer according to an embodiment.

FIG. 3 shows the handle portion 200 from which the handle case 250 shown in FIG. 1 is separated according to an embodiment. FIG. 3 shows a handle frame 400 provided within the handle portion 200.

As described above, the hair dryer according to an embodiment may include the main body 100, the handle portion 200, the gas flow path 150 and the fan unit 300. The main body 100 may be configured to discharge a gas or fluid, such as air externally. That is, the main body 100 may include the gas discharge portion 120 to discharge a gas externally.

The handle portion 200 may extend from the main body 100, and may be configured to enable a gas to flow therein. The handle portion 200 may extend from the main body 100 in the downward direction, and may include the gas intake portion 220 through which a gas may flow in from outside. The gas intake portion 220 may include a plurality of gas intake holes 222 that perforate the handle case 250.

The gas flow path 150 may extend from the gas intake portion 220 to the gas discharge portion 120, whereby a gas may flow therein. A portion of the gas flow path 150 may be located within the main body 100, and the rest of the gas flow path 150 may be located within the handle portion 200. That is, an inside of the main body 100 may form the portion of the gas flow path 150 and an inside of the handle portion 200 may form the rest of the gas flow path 150.

The fan unit 200 may be provided within the handle portion 200 so as to force a gas having flowed into the handle portion 200 to flow toward the gas discharge portion 120. The fan unit 300 may be disposed on or in the gas flow path 150 so as to force a gas to flow.

Figure 4:
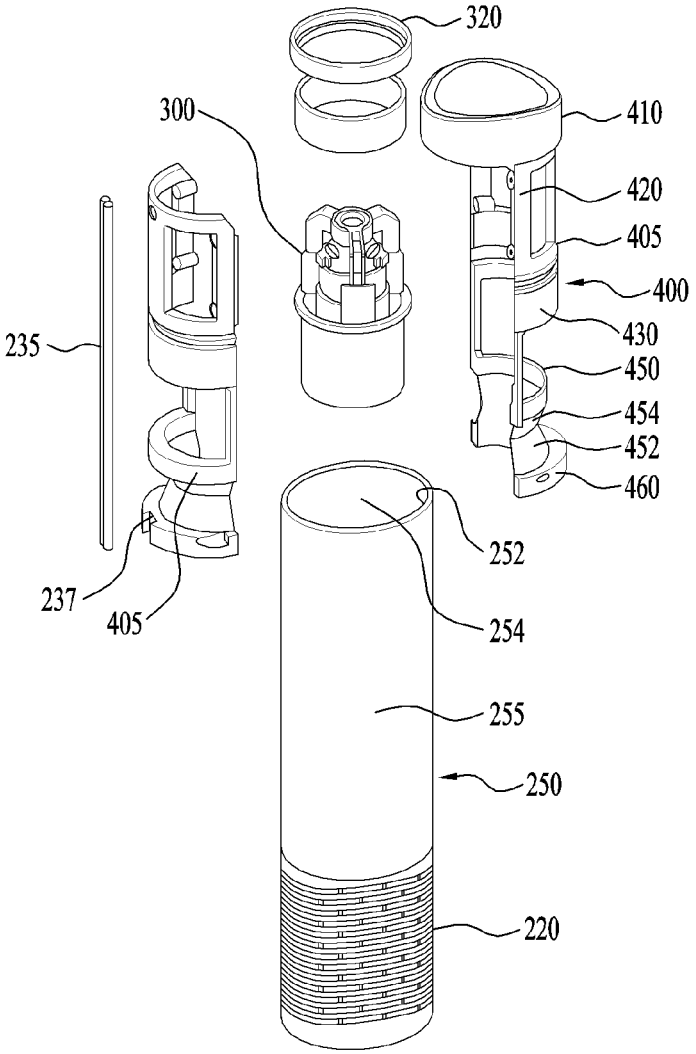
FIG. 4 is a schematic diagram showing a handle frame separated from a hair dryer according to an embodiment.

FIG. 4 shows the handle frame 400 and the handle case 250 separated from the main body 100. Referring to FIG. 3 and FIG. 4, the handle portion 200 may include the handle case 250 and the handle frame 400.

The handle frame 400 may be received in the handle case 250. That is, the handle case 250 may be provided with an inner space 251 forming the gas flow path 150 and configured to form an exterior of the handle portion 200.

FIG. 1 shows the handle case 250 having the handle frame 400 received therein and forming an exterior of the handle portion 200. FIG. 4 shows the handle case 250 separated from the handle frame 400.

The handle case 250 has the inner space 251 that may form the gas flow path 150. Moreover, the handle frame 400 may be located in the inner space 251.

The handle frame 400 may be disposed in the inner space 251 of the handle case 250, and the fan unit 300 may be coupled to the handle frame 400. That is, the handle frame 400 may extend from the main body 100 in the downward direction and be disposed in the inner space 251 of the handle case 250. A top end portion or end of the handle frame 400 may be coupled to the main body 100.

As described above, the lengthwise direction of the handle portion 200 may be defined and described as an upward-downward direction for clarity of description. The upward-downward direction may be defined irrespective of the ground or direction of gravity. With reference to the lengthwise direction of the handle portion 200, a direction from the handle portion 200 toward the main body 100 may correspond to the upward direction and a direction away from the main body 100 may correspond to the downward direction. Therefore, according to an embodiment, the handle portion 200 may be understood as extending from the main body 100 in the downward direction.

The handle frame 400 may be integrally formed with the main body 100. Alternatively, the handle frame 400 may be separately manufactured and then coupled to the main body 100. A top end portion or end of the handle frame 400 may be coupled to the main body 100 in various ways. For example, the top end portion of the handle frame 400 may be coupled to the main body 100 in various ways, such as hook coupling, magnetic coupling, fit coupling, or screw coupling, for example.

The handle fame 400 may have a shape extending from the main body 100 in the downward direction. The handle frame 400 may be located in the inner space 251 of the handle case 250, and may have the fan unit 300 coupled thereto.

Figure 7:
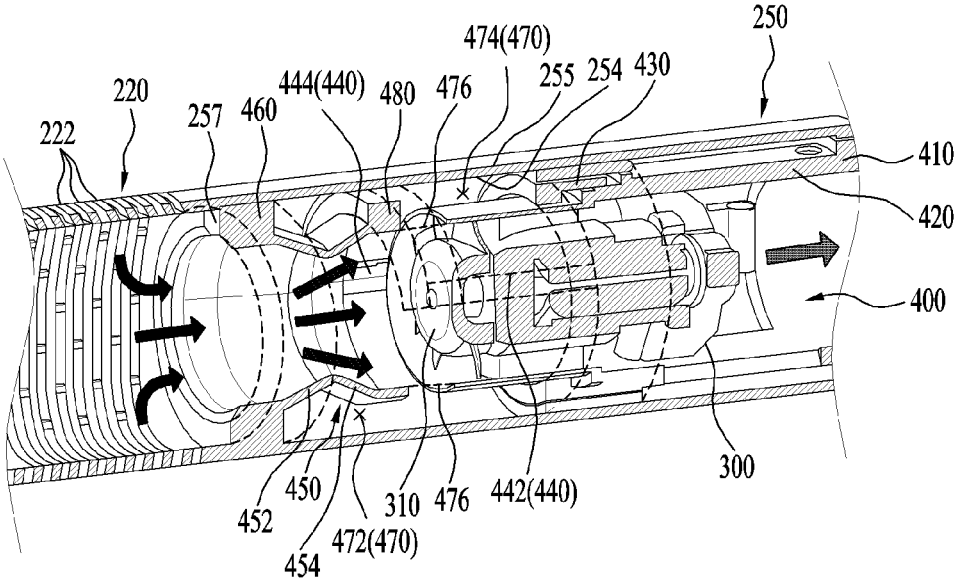
FIG. 7 is a cross-sectional view showing an inside of a handle portion in a hair dryer according to an embodiment.

The fan unit 300 may be coupled to the handle frame 400 and disposed in a manner of being spaced apart from an inner circumferential surface 254 of the handle case 250. That is, the fan unit 300 may be spaced apart inward from the handle case 250 in a manner of being received in the handle frame 400. FIG. 7 shows the fan unit 300 spaced apart inward from the inner circumferential surface 254 of the handle case 250 according to an embodiment.

The fan unit 300 may be coupled and fixed to the handle frame 400, and the handle frame 400 may be inserted into and received in the handle case 250, thereby implementing a structure that the fan unit 300 is efficiently disposed in the handle portion 200. Accordingly, as described hereinafter, in order for the fan unit 300 to be received in the handle case 250, the handle case 250 does not need to be configured with a plurality of divided bodies. Thus, as airtightness is improved, it may be advantageous for gas flow, such as volume, for example. In addition, as the fan unit 300 is not directly coupled to the inner circumferential surface 254 of the handle case 250 and the fan unit 300 and the handle case 250 are spaced apart by each other through the handle frame 400, a considerable amount of vibration and/or noise generated by the fan unit 300 may be prevented by being discharged externally through the handle case 250.

The handle case 250 may be coupled to the handle frame 400, the main body 100, or both the handle frame 400 and the main body 100. The handle frame 400 may have various shapes. The handle frame 400 may be located on or at one side of the gas flow path 150, or the gas flow path 150 may be formed inside of the handle frame 400.

The fan unit 300 and the handle frame 400 may be coupled together in various ways, such as magnetic coupling, hook coupling, fit coupling, or a screw coupling, for example.

Referring to FIG. 4, the handle frame 400 may include a top coupling portion 410. The top coupling portion 410 may be provided to a top end portion or end of the handle frame 400 and coupled to the main body 100. That is, the handle frame 400 may be coupled and fixed to the main body 100 through the top coupling portion 410 provided at the top end portion thereof.

As described above, the top coupling portion 410 may be coupled to the main body 100 in various ways. While the top coupling portion 410 may be coupled to the main body 100, the handle frame 400 may have a shape such that the rest of the handle frame 400 extends away from the main body 100.

The handle frame 400 may be inserted into the inner space 251 through an open top side 252 of the handle case 250. The handle case 250 may have a shape that the top side 252 is open. While the handle case 250 moves toward the main body 100, the handle frame 400 may be inserted into the handle case 250 through the open top side 252.

The top end portion of the handle case 250 may be configured to adhere closely to an outer wall of the main body 100. Hence, gas leakage through a contact surface between the handle case 250 and the main body 100 may be minimized.

Further, the top end portion of the handle case 250 may be configured to enclose the handle frame 400. Hence, regarding the gas in the gas flow path 150, primary airtightness may be secured by close adherence between the handle case 250 and the handle frame 400, and secondary airtightness may be secured by close adherence between the handle case 250 and the outer wall of the main body 100.

Referring to FIG. 3 and FIG. 4, the top coupling portion 410 may be configured in a ring shape that extends along a circumferential direction of the handle portion 200, whereby a gas may flow inside. The term "ring shape" may refer to a shape that extends to form a closed curve in a cross-section such that a closed cross-section is formed inside. The closed curve may include a circle or polygon.

The top coupling portion 410 may be configured in the ring shape and may include a hollow portion formed thereinside. The hollow portion of the top coupling portion 410 may form a portion of the gas flow path 150. That is, the gas forced to flow by the fan unit 300 within the handle portion 200 may flow into the main body 100 by passing through the inside of the top coupling portion 410. As the top coupling portion 410 in the ring shape is coupled to the main body 100 and configured to enable a gas to flow inside, it is able to minimize air volume loss or gas leakage from a coupling region between the handle portion 200 and the main body 100.

Figure 5:
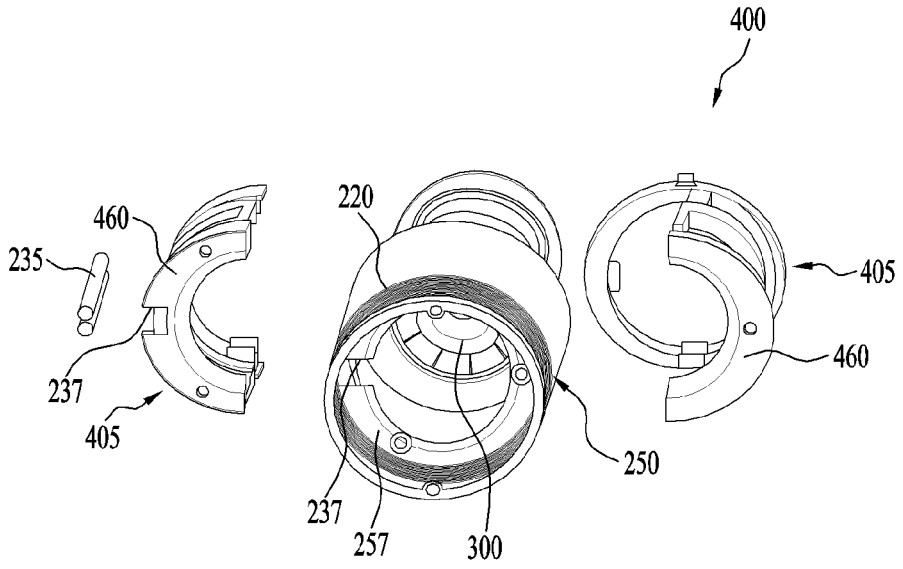
FIG. 5 is a schematic diagram showing a frame coupling portion of a handle case in a hair dryer according to an embodiment.
Figure 6:
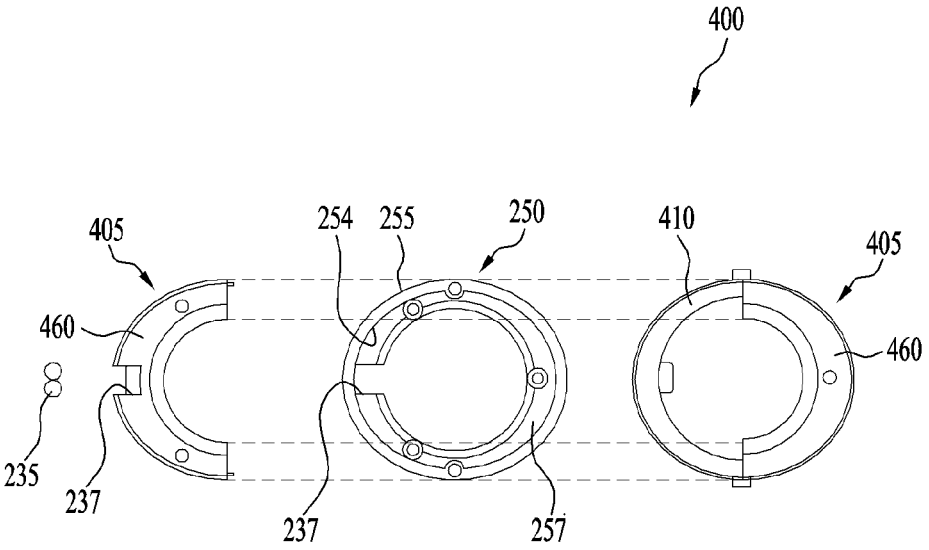
FIG. 6 is a schematic diagram of a handle case and a handle frame in a hair dryer according to an embodiment, viewed in a downward direction.

FIGS. 4 to 6 show that the handle frame 400 may include a plurality of divided bodies (or pieces or components) 405. Referring to FIGS. 4 to 6, according to an embodiment, the handle frame 400 may include a plurality of the divided bodies 405 divided along a circumferential direction.

A predetermined divided body 405 among the plurality of the divided body 405 may include the top coupling portion 410, and the rest of the divided bodies 405 may be coupled to the predetermined divided body 405 in the downward direction of the top coupling portion 410.

The handle frame 400 may be received in the handle case 250 while having the fan unit 300 coupled thereinside. Thus, the handle frame 400 may be configured with a plurality of the divided bodies 405 to facilitate the fan unit 300 to be installed inside.

As the handle frame 400 is divided along the circumferential direction, it may include a plurality of the divided bodies 405. Each of the divided bodies 405 may extend in a lengthwise direction parallel with a lengthwise direction of the handle portion 200. That is, a plurality of the divided bodies 405 may be disposed along the circumferential direction and coupled with each other to form the complete handle frame 400.

The top coupling portion 410 may be formed as a complete integral body that is not divided and coupled to one of the plurality of the divided bodies 405. That is, in the handle frame 400, a bottom region of the top coupling portion 410 may be divided into a plurality of the divided bodies 405.

According to an embodiment, as the handle frame 400 is divided into a plurality of the divided bodies 405 from the bottom of the top coupling portion 410, the top coupling portion 410 may be coupled to the main body 100 without being divided. Therefore, structural stability may be improved and airtightness of gas at the top coupling portion 410, inside of which the gas flows, may be enhanced.

A number or shape of the divided bodies 405 configuring the handle frame 400 may be determined variously, if necessary. FIGS. 4 to 6 show that the handle frame 400 is configured with two divided bodies 405 according to an embodiment.

As shown in FIG. 4, the fan unit 300 may further include a motor mount 320. The motor mount 320 may be configured to receive a fan motor inserted thereinside and enclose an outside of the fan motor.

As the handle case 250 may be formed by injection molding, the inner space 251 may be formed with the top side 252 of the handle case 250 open. That is, the handle case 250 may be formed integrally. The handle case 250 may be injection-molded in a manner of having the inner space 251 and the open top side 252. A bottom side 253 may be integrally formed with an outer circumferential surface 255 or have an open shape, if necessary. FIG. 5 and FIG. 6 shows that the bottom side 253 of the handle case 250 may be open and a bottom portion for closing the bottom side 253 may be separately manufactured to be coupled thereto.

As the fan unit 300 may be inserted into the handle case 250 in a manner of being fixed to the handle frame 400, the handle case 250 may be formed as an integral body instead of being configured with a plurality of divided bodies.

That is, a separate assembly line is not formed for the handle case 250. Therefore, airtightness of a gas flowing within the handle case 250 may be considerably improved. Moreover, as assembly is omitted, aesthetic impression is enhanced and assembly tolerance, for example, minimized, whereby assembly completeness may be enhanced.

Referring to FIG. 3 and FIG. 4, in the hair dryer according to an embodiment, the handle frame 400 may further include a fan unit coupling portion 430. The fan unit coupling portion 430 may be disposed in a manner of being spaced apart from the top coupling portion 410 in the downward direction, configured in a ring shape that extends along the circumferential direction, and configured to have the fan unit 300 coupled thereinside.

The fan unit coupling portion 430 may be spaced apart from the top coupling portion 410 in the downward direction. That is, the fan unit coupling portion 430 may be located farther from the main body 100 than the top coupling portion 410 and closer to the gas intake portion 220 of the handle case 250.

A cross-section of the fan unit coupling portion 430 may be configured to have a ring shape in a manner similar to that of the top coupling portion 410. FIG. 3 and FIG. 4 show the fan unit coupling portion 430 and the top coupling portion 410 having approximately circular ring shapes according to an embodiment.

The fan unit coupling portion 430 may have the fan unit 300 coupled thereinside. That is, the fan unit coupling portion 430 may enclose at least a portion of the fan unit 300 along the circumferential direction. The fan unit 300 may be coupled to the fan unit coupling portion 430 disposed in a manner of being spaced apart from the top coupling portion 410 in the downward direction and received in the handle case 250 effectively.

Referring to FIG. 3 and FIG. 4, the handle frame 400 may further include top connecting portion 420. The top connecting portion 420 may be provided between the top coupling portion 410 and the fan unit coupling portion 430, thereby connecting the top coupling portion 410 and the fan unit coupling portion 430 together. A plurality of the top connecting portion 420 may be provided in a manner of being disposed along the circumferential direction by being spaced apart from each other.

The top connecting portion 420 may have various shapes. Various numbers of the top connecting portions may be provided. FIG. 3 and FIG. 4 shows four top connecting portions 420 extended in the upward-downward direction, that is, the lengthwise direction of the handle portion 200 in a manner of being disposed spaced apart from each other.

A predetermined one of the top connecting portions 420 may be provided to a plurality of the divided bodies 405. That is, a portion of a predetermined one of the top connecting portions 420 may be provided to a predetermined one of the divided bodies 405 and the rest may be provided to another divided body 405.

The top connecting portion 420 may be configured to connect the top coupling portion 410 and the fan unit coupling portion 430 together. One or a first side of the top connecting portion 420 may be connected to the top coupling portion 410 and the other or a second side may be connected to the fan coupling portion 430.

One or a first end portion or end of the top connecting portion 420 may be provided to the top coupling portion 410 and the other or a second end portion may be provided to the fan unit coupling portion 430. The top connecting portion 420 may be integrally formed with the top coupling portion 410 and the fan unit coupling portion 430. Alternatively, the top coupling portion 420 may be separately manufactured and coupled to the top coupling portion 410 and the fan unit coupling portion 430.

For example, the top connecting portion 420 may extend in the downward direction from the top coupling portion 410 so as to be coupled to the fan unit coupling portion 430, or the top connecting portion 420 may extend in the upward direction from the fan unit coupling portion 430 so as to be coupled to the top connecting portion 410.

According to an embodiment, as the fan unit coupling portion 430 is disposed in a manner of being spaced apart from the top coupling portion 410 in the downward direction through the top connecting portion 420, the fan unit 300 may be provided to an appropriate location within the handle case 250. As a plurality of the top connecting portions 420 may be disposed in a manner of being spaced apart from each other in a circumferential direction, a space for reducing noise existing in the case may be secured between the plurality of the top connecting portions 420.

Referring to FIG. 3 and FIG. 4, the handle frame 400 may further include a bottom connecting portion 460. The bottom connecting portion 460 may be disposed in a manner of being spaced apart from the fan unit coupling portion 430 in the downward direction and coupled to the handle case 250.

In addition, as described hereinafter, the bottom coupling portion 460 may be provided to or at a bottom end portion or end of a flow stabilizing portion (flow stabilizer) 450 of the handle frame 400.

The handle frame 400 may be coupled to the handle case 250 within the handle case 250. The bottom coupling portion 460 may be provided to or at a bottom end portion or end of the handle frame 400, that is, an end portion opposite to the main body 100.

As the handle frame 400 and the handle case 250 may be coupled together within the handle case 250 through the bottom coupling portion 460, the coupling structure is not externally exposed. Therefore, aesthetic impression of a product exterior may be enhanced and airtightness of the inside of the handle case 250 may be improved.

The bottom coupling portion 460 and the handle case 250 may be coupled together in various ways. For example, the bottom coupling portion 460 may be coupled to the inner circumferential surface 254 of the handle case 250 in various ways, such as magnetic coupling, screw coupling, or hook coupling, for example.

In addition, as described hereinafter, the handle case 250 may include a frame coupling portion 257 that projects from the inner circumferential surface 254. As the bottom coupling portion 460 of the handle frame 400 and the frame coupling portion 257 may be coupled together through a means, such as a bolt, for example, the handle case 250 may be fixed by the handle frame 400.

The gas intake portion 220 may be provided to or in an outer circumferential surface 255 of the handle case 250 and located below the bottom coupling portion 460. FIG. 7 shows a positional relationship between the bottom coupling portion 460 and the gas intake portion 220.

The gas intake portion 220 may be formed on the outer circumferential surface of the handle case 250, thereby securing a gas intake area sufficiently. Moreover, the bottom coupling portion 460 may be located above the gas intake portion 220, that is, located closer to the main body 100.

The handle frame 400 may entirely form at least a portion of the gas flow path 150 in which a gas may flow. The gas flowing into the handle case 250 through the gas intake portion 220 may pass through the bottom coupling portion 460 and flow to the fan unit 300.

The bottom coupling portion 460 may be located above the gas intake portion 220 at least in the handle case 250. Hence, the handle case 250 may secure a space below the bottom coupling portion 460, whereby additional components may be disposed.

For example, as described hereinafter, the gas intake portion 220 may be disposed below the bottom coupling portion 460 and a space for disposing a filter portion (filter) 230 may be secured inside of the gas intake portion 220. Thus, the handle case 250 and the handle frame 400 may be stably coupled together through the bottom coupling portion 460 and a space may be easily secured below the handle frame 400.

FIG. 5 shows the bottom coupling portion 460 of the handle frame 400 and the frame coupling portion 257 of the handle case 250 according to an embodiment. FIG. 6 shows the bottom coupling portion 460 and the frame coupling portion 257, viewed in the downward direction. FIG. 7 shows that the bottom coupling portion 460 and the frame coupling portion 257 coupled together according to an embodiment.

Referring to FIGS. 5 to 7, the handle case 250 may include the frame coupling portion 257 that projects from the inner circumferential surface 254 of the handle case 250 so as to be coupled to the bottom coupling portion 460. The frame coupling portion 257 may be located on the inner circumferential surface 254 of the handle case 250 and project inward from the inner circumferential surface 254. That is, the frame coupling portion 257 may have a projection height in a direction parallel to a radial direction of the handle case 250.

The frame coupling portion 257 may contact with the bottom coupling portion 460. The bottom coupling portion 460 may be coupled to the frame coupling portion 257 within the handle case 250. The frame coupling portion 257 may be integrally formed with the inner circumferential surface 254 of the handle case 250. Alternatively, the frame coupling portion 257 may be coupled to the inner circumferential surface 254 of the handle case 250 by being manufactured separately from the handle case 250. The frame coupling portion 257 and the bottom coupling portion 460 may be configured in ring shapes that extend along the circumferential direction, whereby the gas flowing from the gas intake portion 220 may flow to the fan unit 300 by passing through the inside.

Referring to FIG. 5 and FIG. 6, the frame coupling portion 257 and the bottom coupling portion 460 may have ring shapes, respectively. The frame coupling portion 257 may have the ring shape that projects from the inner circumferential surface 254 of the handle case 250, and the bottom coupling portion 460 may be located below the fan unit coupling portion 430 and have the ring shape. Thus, the gas flowing from the gas intake portion 220 may flow inside of the frame coupling portion 257 and the bottom coupling portion 460. As the frame coupling portion 257 and the bottom coupling portion 460 are located between the gas intake portion 220 and the fan unit 300, the gas flowing in through the gas intake portion 220 may pass through hollow portions of the frame coupling portion 257 and the bottom coupling portion 460 and flow toward the fan unit 300.

In a case in which the handle frame 400 includes a plurality of the divided bodies 405, a portion of the bottom coupling portion 460 may be provided to a predetermined one of a plurality of the divided bodies 405 and the rest may be provided to the rest of the divided bodies 405. That is, the bottom coupling portion 460 may be configured in a manner of being divided by a plurality of the divided bodies 405. As a plurality of the divided bodies 405 is combined or coupled together, the bottom coupling portion 460 may be coupled or formed into an integral body.

A wire 235 and a wire groove 237 are shown in FIG. 5 and FIG. 6. The fan unit 300 may be disposed within the handle case 250, and the fan unit 300 may be configured to be supplied with power by being connected to the wire 235. At least a portion of the wire 235 may extend along the lengthwise direction of the handle portion 200 between the inner circumferential surface 254 of the handle case 250 and the handle frame 400.

Each of the frame coupling portion 257 and the bottom coupling portion 460 may receive the wire 235. The wire 235 received in the frame coupling portion 257 and the bottom coupling portion 460 may extend from the fan unit 300 toward a bottom side of the handle portion 200 and be connected to an external power source, thereby supplying power to the fan unit 300.

Each of the frame coupling portion 257 and the bottom coupling portion 460 may include the wire groove 237. That is, the wire groove 237 may be provided to or in each of the frame coupling portion 257 and the bottom coupling portion 460. The wire groove 237 may have a shape recessed in a radial direction and an open shape in the upward-downward direction.

Once the handle frame 400 and the handle case 250 are coupled together, the wire groove 237 of the frame coupling portion 257 and the wire groove 237 of the bottom coupling portion 460 may be located in a manner of overlapping with each other. That is, while the handle frame 400 and the handle case 250 are coupled together, the wire 235 may extend in the wire grooves 237 of the handle frame 400 and the handle case 250 together.

Figure 9:
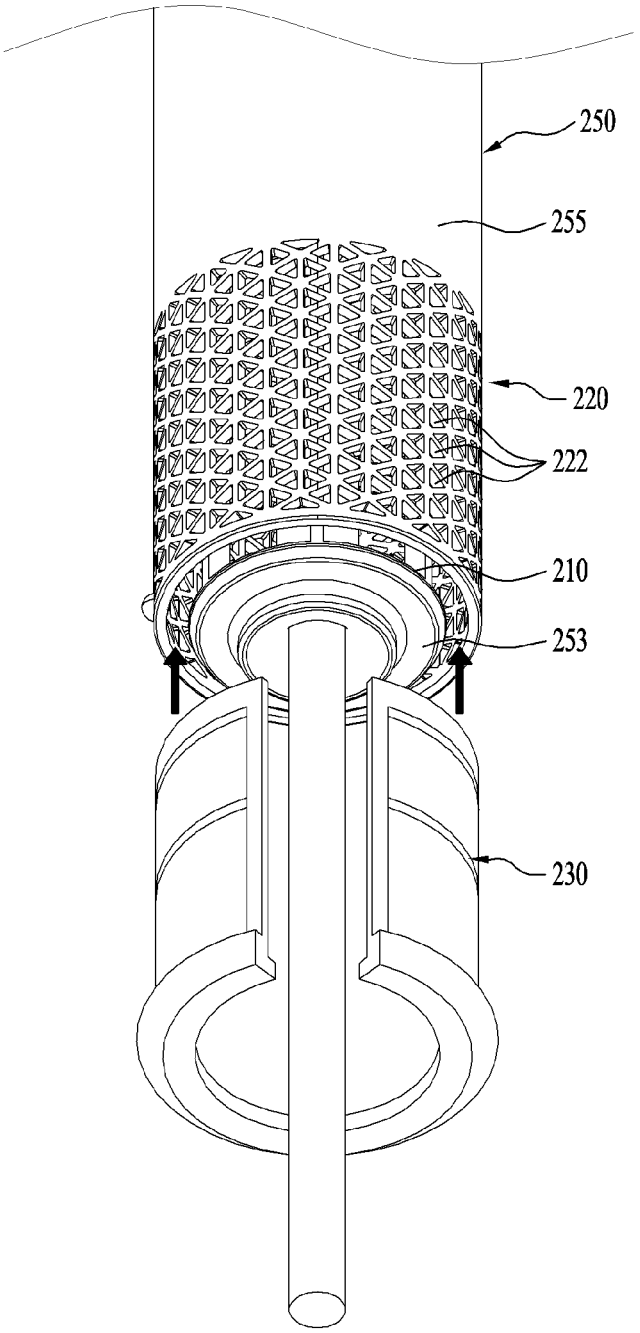
FIG. 9 is a schematic diagram showing a filter portion separated from a handle portion in a hair dryer according to an embodiment.
Figure 10:
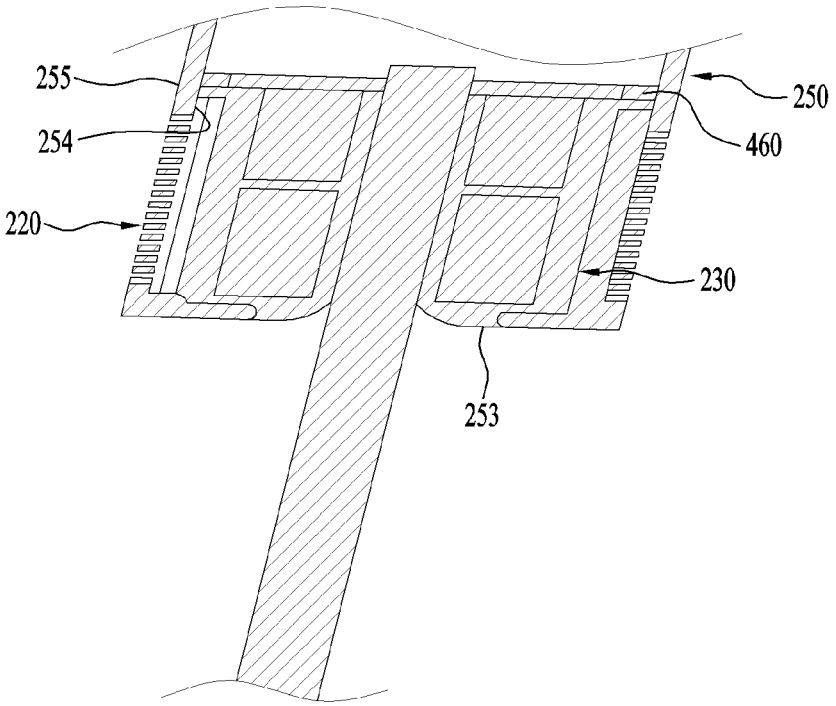
FIG. 10 is a schematic diagram showing an inside of a handle portion having a filter portion coupled thereto in a hair dryer according to an embodiment.

FIG. 9 shows the filter portion (filter) 230 inserted into the handle portion 200 according to an embodiment. FIG. 10 schematically shows the inside of the handle portion 200 having the filter portion 230 inserted therein.

Referring to FIG. 9 and FIG. 10, the filter portion 230 may be further included. The filter portion 230 may filter gas flowing in from the gas intake portion 220 in a manner of being inserted into the handle case 250 through the bottom side 253 of the handle case 250.

The filter portion 230 may be provided within the handle portion 200 and configured to filter out particles in the gas flowing in through the gas intake portion 220. The filter portion 230 may be located below the bottom coupling portion 460 and the frame coupling portion 257.

The filter portion 230 may be configured in a cylindrical shape such that an outer circumferential surface thereof may confront the gas intake portion 220. The gas flowing in from the gas intake portion 220 may flow to the fan unit 300 via the filter portion 230. The filter portion 230 may be configured to enable an outer circumferential surface thereof to adhere closely to the gas intake portion 220 or force the gas intake portion 220 to be sealed from the gas flow path 150.

The filter portion 230 may be configured in a pipe shape having a hollow inside. Hence, the gas flowing into the handle portion 200 through the gas intake portion 220 may be filtered while passing through an outer circumferential surface of the filter portion 230 and then flow toward the fan unit 300 through the hollow portion of the filter portion 230 after passing through the outer circumferential surface of the filter portion 230. As the outer circumferential surface of the filter portion 230 is configured to confront the inner circumferential surface 254 of the handle portion 200, the gas flowing in from the plurality of the gas intake holes 222 may flow into the gas flow path 150 via the filter portion 230.

The filter portion 230 may filter out particles in the gas flowing into the handle portion 200. The gas flowing in through the gas intake portion 220 may pass through the fan unit 300 and then flow into the main body 100. In doing so, the particles in the gas may cause damage or breakage of the fan unit 300.

Therefore, according to embodiments, the filter portion 230 may be located inside of the gas intake portion 220. The gas flowing in through the gas intake portion 220 may be filtered while passing through the filter portion 230 and may then flow to the fan unit 300.

Referring to FIG. 9, a filter inserting portion 210 in which the filter portion 230 may be inserted may be provided to or at an end portion surface of the handle portion 200 located on an opposite side of the main body 100. The filter portion 230 may be inserted into the handle portion 200 through the filter inserting portion 210, whereby the one end portion may be coupled to the second closed portion.

The gas intake portion 220 may be provided on the outer circumferential surface 255 of the handle portion 200 and may be located at an end portion or end of the handle portion 200, that is, at a bottom of the handle portion 200. In addition, the filter inserting portion 210 may be provided to or at an end portion surface opposite to the main body 100, that is, to or at the bottom surface 253.

The filter inserting portion 210 may include a filter inserting hole in which a filter may be inserted. The filter portion 230 may be inserted into the handle portion 200 along the lengthwise direction of the handle portion 200 through the filter inserting portion 210.

Referring to FIG. 7 and FIG. 10, the bottom coupling portion 460 may be coupled to a top side of the frame coupling portion 258, and the filter portion 230 may be coupled to a bottom side of the frame coupling portion 257. That is, the frame coupling portion 257 may be coupled to the bottom coupling portion 460 in the upward direction and the filter portion 230 in the downward direction. A bottom end portion or end of the bottom coupling portion 460 may be coupled to the frame coupling portion 257 and a top end portion or end of the filter portion 230 may be coupled to the frame coupling portion 257.

For example, the bottom coupling portion 460 may be coupled to or at one side of the frame coupling portion 257 facing the main body 100, and the filter portion 230 may be coupled to the other side facing the gas intake portion 220. As a bottom end portion or end of the handle frame 400 is inserted in the downward direction through the open top side 252 of the handle case 250, a bottom side of the bottom coupling portion 460 of the handle frame 400 may be disposed to face the top side of the frame coupling portion 257. As the filter portion 230 is inserted in the upward direction through the filter inserting portion 210 provided at the bottom side 253 of the handle case 250, a top end portion or end of the filter portion 230 may be disposed to face the bottom side of the frame coupling portion 257.

In addition, the filter portion 230 may have a cylindrical shape, each of the frame coupling portion 257 and the bottom coupling portion 460 may have a ring shape, and cross-sections of the filter portion 230, the frame coupling portion 257, and the bottom coupling portion 460 may have approximately circular shapes, respectively. That is, cross-sectional shapes of the filter portion 230, the frame coupling 257, and the bottom coupling portion 460 may have shapes corresponding to one another, whereby the filter portion 230, the frame coupling portion 257, and the bottom coupling portion 460 may establish a mutual coupling relationship in the upward-downward direction.

The filter portion 230, the frame coupling portion 257, and the bottom coupling portion 460 may employ various coupling mechanisms, such as screw coupling, fit coupling, magnetic coupling, or hook coupling, for example. A coupling mechanism between the filter portion 230 and the frame coupling portion 257 may be different from a coupling mechanism between the frame coupling portion 257 and the bottom coupling portion 460. For example, the frame coupling portion 257 and the bottom coupling portion 460 may be mutually coupled together, using a bolt, for example, and the filter portion 230 may be mutually coupled to the frame coupling portion 257 using a magnetic coupling mechanism.

FIG. 3 shows the flow stabilizing portion 450 provided to the handle frame 400 according to an embodiment. FIG. 7 shows the flow stabilizing portion 450 disposed within the handle case 250 according to an embodiment.

Referring to FIG. 7, the handle frame 400 may further include the flow stabilizing portion 450. The flow stabilizing portion 450 may be provided between the bottom coupling portion 460 and the fan unit 300 and configured in a pipe shape to stabilize the gas flow passing thereinside.

The flow stabilizing portion 450 may be located above the gas intake portion 220. That is, the gas intake portion 220 may be located below the flow stabilizing portion 450. The flow stabilizing portion 450 may be configured to stabilize the flow of the gas passing thereinside.

More particularly, the flow stabilizing portion 450 may be provided between the bottom coupling portion 460 and the fan unit 300. The bottom coupling portion 460 may be provided to or at a bottom end portion or end of the flow stabilizing portion 450. The bottom coupling portion 460 may be integrally formed with the flow stabilizing portion 450. Alternatively, the bottom coupling portion 460 may be separately manufactured and coupled to a bottom end of the flow stabilizing portion 450.

The gas intake portion 220 may be located below the bottom coupling portion 460, whereby the flow stabilizing portion 450 may be located above the gas intake portion 220. That is, the gas flowing in through the gas intake portion 220 may be transferred to the fan unit 300 via the flow stabilizing portion 450.

A perforated hole that extends in the lengthwise direction of the handle portion 200, that is, in the upward-downward direction may be formed inside of the flow stabilizing portion 450. That is, the flow stabilizing portion 450 may be configured in a pipe shape having a hollow inside.

The flow stabilizing portion 450 may form a portion of the gas flow path 150 in which the gas flowing from the gas intake portion 220 flows. That is, the gas flowing in from the gas intake portion 220 may be transferred to the fan unit 300 through the flow stabilizing portion 450. The flow stabilizing portion 450 may be configured to stabilize the flow of the gas that passes inside.

For example, the gas flowing in from the gas intake portion 220 may flow unstably due to a flow direction switch of the flow, or a shape of the gas intake portion 200, for example. That is, the flow of the gas flowing in from the gas intake portion 220 may have strong turbulence.

As described above, if the gas flow is closer to turbulence than to a laminar flow, that is, if a strongly turbulent gas flow is transferred to the fan unit 300, the gas flow efficiency by the fan unit 300 may be reduced. For example, if the strongly turbulent air flow is transferred to the fan unit 300 intactly, noise may increase and air volume, for example, may decrease.

Therefore, according to an embodiments disclosed herein, the flow stabilizing portion 450 may be provided between the gas intake portion 220 and the fan unit 300, and the flow of the gas flowing in from the gas intake portion 220 may be stabilized through the flow stabilizing portion 450.

The flow stabilizing portion 450 may have a pipe shape that extends in the lengthwise direction of the handle portion 200, that is, in the upward-downward direction, whereby the complicated air current of the gas flowing in through the gas intake portion 220 may be gradually stabilized while flowing inside of the flow stabilizing portion 450.

As shown in FIG. 3 and FIG. 7, according to an embodiment, the flow stabilizing portion 450 may have a shape that extends from the bottom coupling portion 460 in the upward direction and the handle frame 400 may further include a bottom connecting portion 440.

The bottom connecting portion 440 may be provided between the fan unit coupling portion 430 and the flow stabilizing portion 450. A plurality of the bottom connecting portions 440 may be provided to connect the fan unit coupling portion 430 and the flow stabilizing portion 450 together and disposed in a manner of being spaced apart from each other along the circumferential direction.

More particularly, the bottom coupling portion 460 may be provided to or at a bottom end portion or end of the flow stabilizing portion 450 that may be connected to the fan unit coupling portion 430 through the bottom connecting portion 440. That is, the flow stabilizing portion 450 may be fixed to the handle frame 400 through the bottom connecting portion 440.

The bottom connecting portion 440 may be configured in various shapes. FIG. 3 shows the bottom connecting portion 440 extends along the lengthwise direction of the handle portion 200 to connect the flow stabilizing portion 450 and the fan unit coupling portion 430 together.

A number of the bottom connecting portions 440 may be variously adjusted, if necessary. The bottom connecting portion 440 may be integrally formed with the fan unit coupling portion 430 and the flow stabilizing portion 450. Alternatively, the bottom connecting portion 440 may be separately manufactured and coupled to the fan unit coupling portion 430 and the flow stabilizing portion 450.

The bottom connecting portions 440 may be disposed in a manner of being spaced apart from each other along an inner circumference direction of the handle portion 200, thereby securing spaced rooms or compartments from each other. Hence, a space for reducing noise generated by the gas or the fan unit 300 may be secured.

Figure 8:
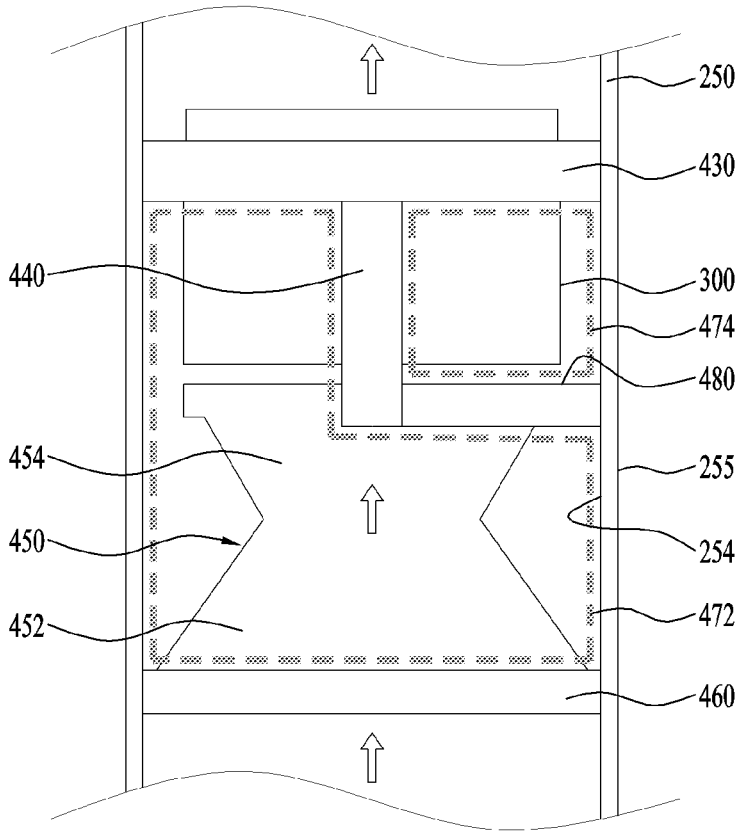
FIG. 8 is a schematic diagram schematically showing a sound absorbing space provided within a handle portion in a hair dryer according to an embodiment.

Referring to FIG. 7 and FIG. 8, according to an embodiment, the flow stabilizing portion 450 may include an inner diameter decreasing portion 452 and an inner diameter increasing portion 454. The inner diameter decreasing portion 452 may extend from the bottom coupling portion 460 in the upward direction and be configured in a manner that an inner diameter decreases away from the bottom coupling portion 460. The inner diameter increasing portion 454 may extend from the inner diameter decreasing portion 452 in the upward direction and be configured in a manner that an inner diameter increases away from the inner diameter decreasing portion 452.

The flow stabilizing portion 450 may include a neck portion or neck provided to or at a point at which the inner diameter decreasing portion 452 and the inner diameter increasing portion 454 meet each other and configured to minimize a cross-sectional area of a gas flow inside. The flow stabilizing portion 450 may have a shape of a venturi tube due to the inner diameter decreasing portion 452 and the inner diameter increasing portion 454.

The inner diameter decreasing portion 452 may be configured to reduce a flow cross-sectional area in a manner that an inner diameter decreases away from the bottom coupling 460, that is, toward the upward direction, gradually. Hence, a gas flowing in through the gas intake portion 220 may flow into the inner diameter decreasing portion 452 via the frame coupling portion 257 and the bottom coupling portion 460. Hence, the flow cross-sectional area of the gas may be reduced by the inner diameter decreasing portion 452 and a flow speed of the gas may be increased. As the flow speed of the gas according to the lengthwise direction of the handle portion 200 is increased, a turbulent component unrelated to the lengthwise direction may be reduced and it may be advantageous for flow stability improvement.

On the other hand, the inner diameter increasing portion 454 may be configured to have an inner diameter that increases gradually away from the inner diameter decreasing portion 452 or toward the upward direction gradually. After the flow velocity of the gas has been increased via the inner diameter decreasing portion 452, it is decreased by the inner diameter increasing portion 454 to increase the flow cross-sectional area. Hence, laminarization may progress. That is, according to an embodiment, flow stability of the gas flowing in from the gas intake hole 222 may be enhanced by the flow stabilizing portion 450 including the inner diameter decreasing portion 452 and the inner diameter increasing portion 454 and gas flow efficiency of the fan unit 300 may be improved by supplying such gas to the fan unit 300.

FIG. 7 shows a sound absorbing space 470 that encloses the fan unit 300. FIG. 8 shows a cross-sectional view of the sound absorbing space 470.

Referring to FIG. 7 and FIG. 8, according to an embodiment, as an outer circumferential surface of the flow stabilizing portion 450 is spaced apart from the inner circumferential surface 254 of the handle case 250, the sound absorbing space 470 may be formed between the outer circumferential surface of the flow stabilizing portion 450 and the inner circumferential surface 254 of the handle case 250. That is, the flow stabilizing portion 450 may be located below the fan unit 300, the gas flowing in through the gas intake portion 220 may flow toward the fan unit 300 by passing through an inside, and the sound absorbing space 470 for reducing noise may be formed between the flow stabilizing portion 450 and the inner circumferential surface 254 of the handle case 250. The sound absorbing space 470 may be defined by the outer circumferential surface of the flow stabilizing portion 450 and the inner circumferential surface 254 of the handle case 250 or by another configuration between the flow stabilizing portion 450 and the handle case 250.

The sound absorbing space 470 may reduce an extent to which noise generated by the gas in the gas flow path 150, such as the flow stabilizing portion 450, for example, or noise generated by the fan unit 300 is radiated externally from the handle portion 200, or as described hereinafter, reduce noise existing in the gas in the gas flow path 150.

The sound absorbing space 470 may include an empty space filled up with air, for example. The sound absorbing space 470 may be filled up with a sound absorbing material for reducing noise, for example, if necessary. A piezoelectric device that vibrates through electric energy, for example, may be disposed in the sound absorbing space 470.

According to an embodiment, by forming the sound absorbing space 470 between the flow stabilizing portion 450, which stabilizes the flow of the gas flowing in from the gas intake portion 220 and generates noise by the gas flow, and the handle case 250, the noise generated by the gas flow or the fan unit 300 may be effectively reduced and ease of use of the hair dryer may be enhanced.

In the hair dryer according to an embodiment, a bottom end portion or end of the fan unit 300 may project from the fan unit coupling portion 430 in the downward direction and be configured to be spaced apart from the inner circumferential surface 254 of the handle case 250, and the sound absorbing space 470 may include a spaced room or compartment between the fan unit 300 and the handle case 250. The spaced room may be formed between the bottom end portion of the fan unit 300 and the inner circumferential surface 254 of the handle case 250 and may correspond to a portion of the sound absorbing space 470. That is, the sound absorbing space 470 may include the space between the flow stabilizing portion 450 and the handle case 250 and further include the space between the fan unit 300 and the handle case 250.

Working noise may be caused by the fan motor of the fan unit 300. Moreover, as a gas passes through the fan, noise in the gas may be generated. Accordingly, at least a portion of the sound absorbing space 470 may be configured to enclose the fan unit 300, whereby vibration and noise generated by the fan unit may be reduced.

As shown in FIG. 7 and FIG. 8, the fan unit coupling portion 430 may be configured to close a top end portion or end of the sound absorbing space 470 from the gas flow path 150 in a manner of adhering closely to the inner circumferential surface 254 of the handle case 250. The fan unit 300 may be coupled to an inside, that is, a hollow portion of the fan unit coupling portion 430, and an outer circumferential surface of the fan unit coupling portion 430 may be configured to adhere closely to the inner circumferential surface 254 of the handle case 250. As a portion of the sound absorbing space 470 is formed between the fan unit 300 and the handle case 250, the top end portion of the sound absorbing space 470 defined between the fan unit 300 and the handle case 250 may be opened/closed by the fan unit coupling portion 430 in the upward direction. The top end portion of the sound absorbing space 470 may be defined by the outer circumferential surface of the fan unit 300, the inner circumferential surface 254 of the handle case 250, and the bottom side of the fan unit coupling portion 430, and may be isolated from the gas flow path 150 by the fan unit coupling portion 430.

As described above, according to an embodiment, as the fan unit coupling portion 430 is configured to adhere closely to the handle case 250, the top end portion of the sound absorbing space 470, that is, the end portion toward the main body 100 may be isolated from the gas flow path 150, and the sound absorbing space 470 may be a separate space separated from the gas flow path 150 and may be used in reducing noise. The bottom coupling portion 460 may be configured to close the bottom end portion of the sound absorbing space 470 from the gas flow path 150 in a manner of adhering closely to the inner circumferential surface 254 of the handle case 250. That is, the bottom end portion of the sound absorbing space 470 may be defined by the inner circumferential surface 254 of the handle case 250 and the top side of the bottom connecting portion 460, and isolated from the gas flow path 150 in a manner that the bottom connecting portion 460 adheres closely to the inner circumferential surface 254 of the handle case 250.

As described above, according to an embodiment, as the bottom connecting portion 460 is configured to adhere closely to the handle case 250, the bottom end portion of the sound absorbing space 470, that is, the end portion facing the gas intake portion 220 may be isolated from the gas flow path 150 and the sound absorbing space 470, which is a space separated from the gas flow path 150, may be used in reducing noise.

Referring to FIG. 7 and FIG. 8, in the hair dryer according to an embodiment, as the flow stabilizing portion 450 is spaced apart from the fan unit 300 in the downward direction, an open region 476 of the sound absorbing space 470 may be formed between the fan unit 300 and the flow stabilizing portion 450. That is, the open region 476 may be formed between the flow stabilizing portion 450 and the fan unit 300, and the sound absorbing space 470 may communicate with the gas flow path 150 through the open region 476.

More particularly, a top end of the flow stabilizing portion 450 connected to the fan unit coupling portion 430 through the bottom connecting portion 440 may be spaced apart from the fan unit 300 in the downward direction, and the open region 476 through which the sound absorbing space 470 communicates with the gas flow path 150 may be formed between the flow stabilizing portion 450 and the fan unit 300. Hence, the sound absorbing space 470 may function as a Helmholtz resonance space having the neck portion communicating with the gas flow path 150. That is, the sound absorbing space 470 may be defined by the inner circumferential surface 254 of the handle case 250, the fan unit coupling portion 430, the fan unit 300, the flow stabilizing portion 450, and the bottom coupling portion 460, and may correspond to the Helmholtz resonance space communicating with the gas flow path 150 through the open region between the fan unit 300 and the flow stabilizing portion 450. A resonance frequency of the sound absorbing space 470 may be determined by design adjustment of a size of the open region 476, that is, a distance between the fan unit 300 and the flow stabilizing portion 450 or an inner volume.

Figure 11:
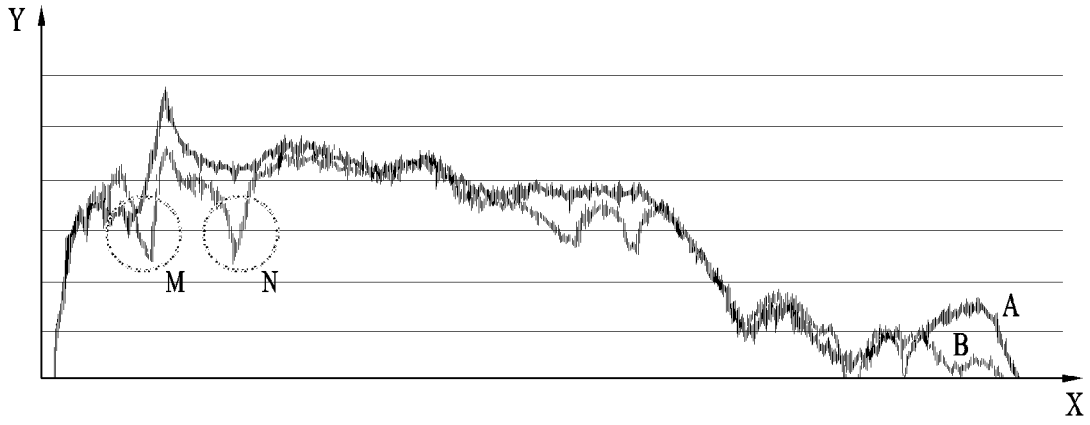
FIG. 11 is a graph showing a noise reduction effect by a sound absorbing space in a hair dryer according to an embodiment.

FIG. 11 is a graph showing a noise reduction effect by the sound absorbing space 470. In FIG. 11, the X-axis corresponds to frequency (Hz) of noise and the Y-axis corresponds to size (db) of the noise.

In FIG. 11, a measurement result A is a result measured in a state in which the sound absorbing space 470 is not provided and a measurement result B is a result measured in a state in which the sound absorbing space 470 is provided. The measurement of noise is performed at a downstream side of the fan unit 300 with reference to a flow of a gas.

Referring to FIG. 11, regarding the measurement result B resulting from forming the sound absorbing space 470 in relation to the measurement A, it can be observed that a size of noise is remarkably reduced as confirmed in a region M and a region N. A target frequency for reducing noise by the sound absorbing space 470 may be changeable, as described above, by adjusting a design factor such as a volume of the sound absorbing space 470, or a size of the open region 476, for example. According to an embodiment, by forming the sound absorbing space 470 enclosing the flow stabilizing portion 450 and the fan unit 300, noise generated from the inside of the handle case 250 may be reduced effectively.

Referring to FIG. 7, according to an embodiment, regarding the fan unit 300, the fan 310 rotated by the fan motor may be provided to or at the bottom end portion of the fan unit 300. That is, the fan 310 of the fan unit 300 may be disposed in a manner of being enclosed by the sound absorbing space 470.

In addition, as the open region 476 is formed between the fan unit 300 and the flow stabilizing portion 450, the fan 310 provided to or at the bottom end portion of the fan unit 300 may be disposed adjacent to the open region 476, whereby noise in the gas generated by the fan 310 may be effectively reduced by the sound absorbing space 470.

The fan 310 of the fan unit 300 may be configured in a manner of not overlapping with the open region 476 along a radial direction of the handle case 250. That is, the fan 310 may be located above the open region 476.

As described above, if the open region 476 corresponds to a region in which the sound absorbing space 470 and the gas flow path 150 communicate with each other and a gas existing in such a region is directly affected by the fan 310, the Helmholtz resonance effect by the sound absorbing space 470 may be lowered. Therefore, according to embodiments, the fan 310 may be located above the open region 476 in a manner of not overlapping with the open region 476 despite being disposed adjacent to the open region 476.

According to an embodiment, the sound absorbing space 470 may include a first sound absorbing space 472 and a second sound absorbing space 474 having different volumes. The handle frame 400 may be configured to isolate the first sound absorbing space 472 and the second sound absorbing space 474 from each other.

FIG. 7 and FIG. 8 show the first sound absorbing space 472 and the second sound absorbing space 474 partitioned from each other by the handle frame 400 according to an embodiment. The sound absorbing space 470 may be partitioned into the first sound absorbing space 472 and the second sound absorbing space 474, and each of the first and second sound absorbing spaces 472 and 474 may be configured to communicate with the gas flow path 150 through the open region 476.

That is, the first sound absorbing space 472 and the second sound absorbing space 474 may correspond to Helmholtz resonance spaces distinguished from each other. The first sound absorbing space 472 and the second sound absorbing space 474 may be configured to have different volumes, thereby having different resonance frequencies, respectively.

Accordingly, noise may be reduced by targeting a plurality of frequency regions in the noise generated in the gas flow path 150. The number of the sound absorbing spaces 470 may be determined as necessary, for example, a third sound absorbing space 470, and a fourth sound absorbing space 470 may be provided.

FIG. 11 shows the result that noise is reduced in different frequency regions by the first sound absorbing space 472 and the second sound absorbing space 474. More particularly, in the measurement B, the region M is the result from reducing the noise by the first sound absorbing space 472 and the region N is the result from reducing the noise by the second sound absorbing space 474.

As described above, according to an embodiment, the sound absorbing space 470 may be partitioned into a plurality of compartments by the handle frame 400, for example, and each resonance frequency may be determined by design, whereby noise may be reduced in a plurality of frequency regions. According to an embodiment, the first sound absorbing space 472 may be located in the space between the flow stabilizing portion 450 and the handle case 250 and a portion of the space between the fan unit 300 and the handle case 250, and the second sound absorbing space 474 may be located in the rest of the space between the fan unit 300 and the handle case 250 except for the first sound absorbing space 472.

That is, a portion of a space between the fan unit 300 and the handle case 250 may correspond to a portion of the first sound absorbing space 472 along the inner circumference direction of the handle case 250 and the rest may correspond to the second sound absorbing space 474. The first sound absorbing space 472 may include the entire space between the flow stabilizing portion 450 and the handle case 250 and may further include a portion of the space between the fan unit 300 and the handle case 250. That is, the first sound absorbing space 472 may have a volume greater than the second sound absorbing space 474.

The second sound absorbing space 474 may include the rest of the space between the fan unit 300 and the handle case 250 except for the first sound absorbing space 472. The second sound absorbing space 474 may have a volume smaller than the first sound absorbing space 472.

The first sound absorbing space 472 may be configured to reduce the noise of a frequency region lower than the second sound absorbing space 474. Thus, noise may be simultaneously reduced in a low frequency region and a high frequency region through volume design of the first and second sound absorbing spaces 472 and 474. As the first sound absorbing space 472 and the second sound absorbing space 474 are configured to enclose the flow stabilizing portion 450 and the fan unit 300 entirely, vibration and noise radiated from the flow stabilizing portion 450 and the fan unit 300 may be reduced effectively.

Referring to FIG. 7 and FIG. 8, according to an embodiment, a plurality of the bottom connecting portions 440 may include first bottom connecting portion 442 and second bottom connecting portion 444 disposed in a manner of being spaced apart from the first bottom connecting portion 442 along the circumferential direction. The first bottom connecting portion 442 and the second bottom connecting portion 444 may partition the space between the first sound absorbing space 472 and the second sound absorbing space 474 along the circumferential direction by adhering closely to the inner circumferential surface 254 of the handle portion 200.

The bottom connecting portion 440 may include the first bottom connecting portion 442 and the second bottom connecting portion 444. The first bottom connecting portion 442 and the second bottom connecting portion 444 may be spaced apart from each other along the inner circumference direction of the handle case 250.

FIGS. 3 to 7 show the first bottom connecting portion 442 and the second bottom connecting portion 444 located on opposite sides centering on the gas flow path 150 according to an embodiment, respectively. The first bottom connecting portion 442 and the second bottom connecting portion 444 may be located on a boundary line between the first sound absorbing space 472 and the second sound absorbing space 474 with reference to the inner circumference direction. That is, the first bottom connecting portion 442 and the second bottom connecting portion 444 may be disposed on both end portions of the first sound absorbing space 472 or the second sound absorbing space 474 with reference to the inner circumference direction. The first bottom connecting portion 442 and the second bottom connecting portion 444 may be configured to partition the space between the first sound absorbing space 472 and the second sound absorbing space 474 along the inner circumference direction or the circumferential direction of the handle portion 200 by adhering closely to the inner circumferential surface 254 of the handle case 250.

FIG. 8 shows a cross-section of the inside of the handle portion 200, viewed in a manner that the bottom connecting portion 440 is located at a center. The bottom connecting portion 440 shown in FIG. 8 may include the first bottom connecting portion 442 or the second bottom connecting portion 444. As the rest is located on the opposite side, it is not shown in FIG. 8.

Referring to FIG. 8, the first sound absorbing space 472 and the second sound absorbing space 474 may be configured to be isolated from each other by the bottom connecting portion 440. Hence, according to an embodiment, the sound absorbing space 470 may be partitioned into the first sound absorbing space 472 and the second sound absorbing space 474 having different volumes, respectively.

The handle frame 400 may further include a space partitioning portion or partition 480. The space partitioning portion 480 may project outward from the top end portion of the flow stabilizing portion 450 and extend along the circumferential direction.

The first bottom connecting portion 442 and the second bottom connecting portion 444 may be connected to both end portions or ends of the space partitioning portion 480, respectively. The space partitioning portion 480 may partition the first sound absorbing space 472 and the second sound absorbing space 474 along the upward-downward direction by adhering closely to the inner circumferential surface 254 of the handle portion 200.

More particularly, the space partitioning portion 480 may be configured to partition the space between the bottom end portion of the second sound absorbing space 474 and the first sound absorbing space 472. The space partitioning portion 480 may be formed at a portion of the top end portion of the flow stabilizing portion 450.

The space partitioning portion 480 may adhere closely to the inner circumferential surface 254 of the handle portion 200 by projecting outward from the top end portion of the flow stabilizing portion 450. That is, as the space partitioning portion 480 is formed at a portion of the top end portion of the flow stabilizing portion 450, it may adhere closely to the inner circumferential surface 254 of the handle portion 200 and the rest of the top end portion of the flow stabilizing portion 450 may be spaced apart from the inner circumferential surface 254 of the handle portion 200.

Regarding the top end portion of the flow stabilizing portion 450, the space partitioning portion 480 adhering closely to the inner circumferential surface 254 of the handle portion 200 is configured to separate the first sound absorbing space 472 and the second sound absorbing space 474 from each other along the lengthwise direction of the handle portion 200. The room spaced apart from the inner circumferential surface 254 of the handle portion 200 in the top end portion of the flow stabilizing portion 450 may correspond to a portion of the first sound absorbing space 472.

With reference to the space partitioning portion 480, the second sound absorbing space 474 may be located above and the first sound absorbing space 472 may be located below. That is, the first sound absorbing space 472 may form a single space in a manner that a space enclosing the flow stabilizing portion 450 communicates with a space enclosing a portion of the fan unit 300 through a region of the top end portion of the flow stabilizing portion 450 to which the space partitioning portion 480 is not provided, whereby the first sound absorbing space 472 having a volume larger than the second sound absorbing space 474 may be formed.

In addition, the space partitioning portion 480 may extend along the inner circumference direction of the handle portion 200, and the first bottom connecting portion 442 and the second bottom connecting portion 444 may be connected to both end portions of the space partitioning portion 480, respectively. That is, a bottom end of the first bottom connecting portion 442 and a bottom end of the second bottom connecting portion 442 may be connected to both of the end portions of the space partitioning portion 480, respectively.

The space partitioning portion 480 may be integrally formed with the flow stabilizing portion 450 or the bottom connecting portion 440. Alternatively, the space partitioning portion 480 may be separately manufactured and coupled to the flow stabilizing portion 450 or the bottom connecting portion 440. The second sound absorbing space 474 may be formed between the fan unit coupling portion 430 and the space partitioning portion 480 and between the first bottom connecting portion 442 and the second bottom connecting portion 444.

FIG. 8 schematically shows that the first sound absorbing space 472 and the second sound absorbing space 474 are partitioned from each other by the bottom connecting portion 440 and the space partitioning portion 480. The first sound absorbing space 472 and the second sound absorbing space 474 may be partitioned by the handle frame 400 and each communicate with the gas flow path 150 through the open region 476 each, whereby noise of different frequency regions may be reduced.

Accordingly, embodiments disclosed herein are directed to a hair dryer that substantially obviates one or more problems due to limitations and disadvantages of the related art.

Embodiments disclosed herein provide a hair dryer having a fan unit (fan) disposed within a handle portion (handle) stably and efficiently. Embodiments disclosed herein further provide a hair dryer capable of effectively reducing vibration and noise generated by a fan unit. Embodiments disclosed herein furthermore provide a hair dryer capable of efficiently reducing flow loss of a gas forced to flow by fan unit.

Technical tasks obtainable from embodiments are non-limited by the above-mentioned technical tasks. And, other unmentioned technical tasks may be clearly understood from the description by those having ordinary skill in the technical field to which the embodiments pertains.

Additional advantages, objects, and features of the disclosure will be set forth in the disclosure herein as well as the accompanying drawings. Such aspects may also be appreciated by those skilled in the art based on the disclosure herein.

According to embodiments disclosed herein, a fan unit may be disposed within a handle portion. When the fan unit is provided within the handle portion, a method of dividing the handle portion into divided bodies and combining the divided bodies together may be used.

If the handle portion is constructed with the divided bodies, an assembly surface between the divided bodies is created, and sealing inside of the handle portion is lowered by the assembly surface, which may cause loss of flow, such as reduction of wind volume, and may adversely affect gas flow inside of the handle portion. In addition, it may be disadvantageous for completeness of a product and user perception, such as the externally exposed assembly surface of the handle portion and a step difference occurrence due to manufacturing error of the assembly surface.

According to embodiments disclosed herein, a handle portion may include a handle case and a handle frame, components, such as a fan unit, for example, may be provided to or in the handle frame, and the handle case may be coupled to enclose the handle frame. Accordingly, embodiments disclosed herein may reliably and effectively dispose components, such as the fan unit, for example, inside of the handle case, and the handle case that forms the appearance of the handle portion does not need to be composed of divided bodies, which may be advantageous for gas flow and improve product completeness.

To achieve these objects and other advantages and in accordance with the purpose of the disclosure, as embodied and broadly described herein, a hair dryer according to an embodiment may include a main body, a handle portion (handle), a gas flow path (flow path), and a fan unit (fan). The main body may include a gas discharge portion (discharge outlet) that discharges a gas (fluid) externally. The handle portion may extend from the main body in a bottom (downward) direction and include a gas intake portion (inlet) forcing a gas to flow in from an outside.

The gas flow path may extend from the gas intake portion to the gas discharge portion to enable the gas to flow. The fan unit may be provided within the handle portion and disposed on the gas flow path to force the gas to flow.

The handle portion may include a handle case and a handle frame. The handle case may have an inner space for forming the gas flow path and may be configured to form an exterior of the handle portion. The handle frame may extend from the main body in the downward direction so as to be disposed in the inner space of the handle case.

The fan unit may be coupled to the handle frame and disposed in a manner of being spaced apart from an inner circumferential surface of the handle case. Accordingly, as the fan unit may be effectively disposed within the handle portion, embodiments disclosed herein may have a stably fixed structure. As the fan unit and the handle case are spaced apart from each other, vibration or noise radiated from the fan unit to an outside of the handle case may be reduced effectively.

The handle frame may include a top coupling portion provided to a top end portion or end of the handle frame. The handle frame may be coupled to the main body through the top coupling portion and inserted in the inner space of the handle case through an open top surface of the handle case. The top coupling portion may be configured in a ring shape extended along a circumferential direction of the handle portion and configured to enable the gas to flow inside.

The handle case may be formed by injection molding so as to form the inner space and have an open-top surface shape. The handle frame may further include a fan unit coupling portion disposed by being spaced apart from the top coupling portion in the downward direction, configured in a ring shape extended along the circumferential direction, and having the fan unit coupled inside.

The hair dryer may further include a plurality of top connecting portions provided between the top coupling portion and the fan unit coupling portion, disposed by being spaced apart from each other along the circumferential direction, and connecting the top coupling portion and the fan unit coupling portion together. The handle frame may further include a bottom coupling portion disposed by being spaced apart from the fan unit coupling portion in the downward direction and coupled to the handle case.

The gas intake portion may be provided to or in an outer circumferential surface of the handle case and located below the bottom coupling portion. The handle case may include a frame coupling portion projected from the inner circumferential surface of the handle case and coupled to the bottom connecting portion.

The frame coupling portion and the bottom coupling portion may be configured in a ring shape extended along the circumferential direction so that the gas flowing in from the gas intake portion flows to the fan unit by passing through an inside.

A filter inserting portion may be provided to a bottom surface of the handle case and the handle case may further include a filter portion inserted in the handle case through the filter inserting portion to filter the gas flowing in from the gas intake portion. The frame coupling portion may be coupled to the bottom coupling portion in the upward direction and coupled to the filter portion in the downward direction.

The handle frame may further include a flow stabilizing portion (flow stabilizer) provided between the bottom coupling portion and the fan unit and configured in a pipe shape to stabilize a flow of a gas passing inside. The flow stabilizing portion may extend from the bottom coupling portion in the upward direction, and the handle frame may further include a plurality of bottom connecting portions provided between the fan unit coupling portion and the flow stabilizing portion, disposed by being spaced apart from each other along the circumferential direction, and connecting the fan unit coupling portion and the flow stabilizing portion to each other.

The flow stabilizing portion may include an inner diameter decreasing portion extended from the bottom connecting portion in the upward direction and configured to have an inner diameter decreasing away from the bottom coupling portion and an inner diameter increasing portion extended from the inner diameter decreasing portion in the upward direction and configured to have an inner diameter increasing away from the inner diameter decreasing portion.

An outer circumferential surface of the flow stabilizing portion may be spaced apart from the inner circumferential surface of the handle case so that a sound absorbing space is formed between the flow stabilizing portion and the inner circumferential surface of the handle case. A bottom end portion of the fan unit may project from the fan unit coupling portion in the downward direction and be configured to be spaced apart from the inner circumferential surface of the handle case. The sound absorbing space may include a spaced room between the fan unit and the handle case.

The flow stabilizing portion may be spaced apart from the fan unit in the downward direction and an open region communicating with the gas flow path between the flow stabilizing portion and the fan unit may be formed in the sound absorbing space.

The handle frame may include a plurality of divided bodies divided along the circumferential direction, a prescribed or predetermined one of the plurality of the divided bodies may include the top coupling portion. The rest of the divided bodies may be coupled to the prescribed divided body below the top coupling portion.

Embodiments disclosed herein further provide a hair dryer that may include a main body configured to discharge a gas (fluid) externally, a handle portion (handle) extended from the main body and configured to enable a gas to flow in, and a fan unit (fan) provided within the handle portion and configured to force the gas flowing into the handle portion to flow toward the main body.

The handle portion may include a handle frame having a top end portion or end coupled to the main body, and a handle case configured to receive the handle frame inside, and the fan unit may be received in the handle frame so as to be spaced apart from the handle case inside.

Accordingly, embodiments disclosed herein may provide at least the following effects and/or advantages.

First, embodiments disclosed herein may provide a hair dryer having a fan unit disposed within a handle portion stably and efficiently. Second, embodiments disclosed herein may provide a hair dryer capable of effectively reducing vibration and noise generated by a fan unit. Third, embodiments disclosed herein may provide a hair dryer capable of effectively reducing flow loss of a gas forced to flow by a fan unit.

Effects obtainable from embodiments may be non-limited by the above-mentioned effects. And, other unmentioned effects may be clearly understood from the description by those having ordinary skill in the technical field to which embodiments pertains. It is to be understood that both the general description and description of embodiments are exemplary and explanatory and are intended to provide further explanation of the disclosure as claimed.

It will be apparent to those skilled in the art that various modifications and variations can be made without departing from the spirit or scope. Thus, it is intended that embodiments covers the modifications and variations provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer comprising:

a main body including a discharge outlet that discharges fluid externally;

a handle that extends from the main body in a downward direction and including an inlet through which fluid is drawn in from outside;

a flow path that extends from the inlet to the discharge outlet along which the fluid flows; and a fan provided within the handle and disposed in the flow path to force the gas to flow, wherein the handle comprises a handle case having an inner space that forms the flow path and configured to form an exterior of the handle and a handle frame that extends from the main body in the downward direction so as to be disposed in the inner space of the handle case, wherein the fan is coupled to the handle frame and spaced apart from an inner circumferential surface of the handle case, wherein the handle frame comprises:

a top coupling portion provided to a top end of the handle frame;

a fan coupling portion spaced apart from the top coupling portion in the downward direction and having the fan coupled thereinside; and a plurality of top connecting portions that connects the top coupling portion and the fan coupling portion in between the top coupling portion and the fan coupling portion, and wherein the plurality of top connecting portions is spaced apart from each other along a circumferential direction to form a space between the plurality of the top connecting portions.

2. The hair dryer of claim 1, wherein the handle frame is coupled to the main body by the top coupling portion and inserted into the inner space of the handle case through an open top surface of the handle case.

3. The hair dryer of claim 2, wherein the handle case is formed by injection molding so as to have the inner space and the open top surface.

4. The hair dryer of claim 3, wherein the handle frame comprises a plurality of divided bodies divided along a circumferential direction, wherein a predetermined one of the plurality of the divided bodies includes the top coupling portion, and wherein the rest of the plurality of divided bodies is coupled to the predetermined divided body below the top coupling portion.

5. The hair dryer of claim 2, wherein the top coupling portion is configured in a ring shape that extends along a circumferential direction of the handle and configured to enable the fluid to flow thereinside.

6. The hair dryer of claim 3, wherein the fan coupling portion is configured in a ring shape that extends along the circumferential direction.

7. The hair dryer of claim 6, wherein the handle frame further comprises a bottom coupling portion spaced apart from the fan coupling portion in the downward direction and coupled to the handle case.

8. The hair dryer of claim 7, wherein the inlet is provided in an outer circumferential surface of the handle case and located below the bottom coupling portion.

9. The hair dryer of claim 8, wherein the handle case comprises a frame coupling portion that projects from the inner circumferential surface of the handle case and coupled to the bottom connecting portion.

10. The hair dryer of claim 9, further comprising:

a filter inserting portion provided at a bottom surface of the handle case; and a filter inserted into the handle case through the filter inserting portion to filter the fluid flowing in through the inlet.

11. The hair dryer of claim 10, wherein the frame coupling portion is coupled to the bottom coupling portion in an upward direction and coupled to the filter in the downward direction.

12. The hair dryer of claim 9, wherein the frame coupling portion and the bottom coupling portion have a ring shape that extends along the circumferential direction so that the fluid flowing in through the inlet flows to the fan by passing through an inside thereof.

13. The hair dryer of claim 9, wherein the handle frame further comprises a flow stabilizer provided between the bottom coupling portion and the fan and configured in a pipe shape to stabilize a flow of fluid passing thereinside.

14. The hair dryer of claim 13, wherein the flow stabilizer extends from the bottom coupling portion in the upward direction, and wherein the handle frame further comprises a plurality of bottom connecting portions provided between the fan coupling portion and the flow stabilizer spaced apart from each other along the circumferential direction, and connecting the fan coupling portion and the flow stabilizer to each other.

15. The hair dryer of claim 13, wherein the flow stabilizer comprises:

an inner diameter decreasing portion that extends from the bottom connecting portion in an upward direction and configured to have an inner diameter that decreases as it extends away from the bottom coupling portion; and an inner diameter increasing portion that extends from the inner diameter decreasing portion in the upward direction and configured to have an inner diameter that increases as it extends away from the inner diameter decreasing portion.

16. The hair dryer of claim 13, wherein an outer circumferential surface of the flow stabilizer is spaced apart from the inner circumferential surface of the handle case so that a sound absorbing space is formed between the flow stabilizer and the inner circumferential surface of the handle case.

17. The hair dryer of claim 16, wherein a bottom end of the fan projects from the fan coupling portion in the downward direction and is spaced apart from the inner circumferential surface of the handle case, and wherein the sound absorbing space includes a space between the fan and the handle case.

18. The hair dryer of claim 17, wherein the flow stabilizer is spaced apart from the fan in the downward direction, and wherein an open region that communicates with the flow path between the flow stabilizer and the fan is formed in the sound absorbing space.

19. A hair dryer, comprising:

a main body;

a handle that extends from the main body and through which fluid flows; and a fan provided within the handle, wherein the fan forces the fluid flowing in the handle to flow toward the main body, wherein the handle comprises a handle frame having a top end coupled to the main body and a handle case configured to receive the handle frame thereinside, wherein the fan is received in the handle frame so as to be spaced apart from the handle case, wherein the handle frame comprises:

a top coupling portion provided to a top end of the handle frame;

a fan coupling portion spaced apart from the top coupling portion in the downward direction and having the fan coupled thereinside; and a plurality of top connecting portions that connects the top coupling portion and the fan coupling portion in between the top coupling portion and the fan coupling portion, and wherein the plurality of top connecting portions is spaced apart from each other along a circumferential direction to form a space between the plurality of the top connecting portions.

* * * * *